US010781599B2

(12) United States Patent
Lambourn et al.

(10) Patent No.: US 10,781,599 B2
(45) Date of Patent: Sep. 22, 2020

(54) POOL CLEANER WITH DIAPHRAGM CASSETTE UNIT AND RETENTION MECHANISM

(71) Applicant: NC Brands, L.P., Norwalk, CT (US)

(72) Inventors: Paul Lambourn, Sydenham (ZA); Robin Owen Ellis, Pine Ridge, FL (US); Michael Richard Tregoning, Edenvale (ZA)

(73) Assignee: NC Brands L.P., Norwalk, CT (US)

( * ) Notice: Subject to any disclaimer, the term of this patent is extended or adjusted under 35 U.S.C. 154(b) by 122 days.

(21) Appl. No.: 15/998,429

(22) Filed: Aug. 15, 2018

(65) Prior Publication Data

US 2019/0055745 A1 Feb. 21, 2019

Related U.S. Application Data

(60) Provisional application No. 62/545,716, filed on Aug. 15, 2017.

(51) Int. Cl.
*E04H 4/16* (2006.01)

(52) U.S. Cl.
CPC ..... *E04H 4/1663* (2013.01); *E04H 4/1636* (2013.01)

(58) Field of Classification Search
CPC ..... E04H 4/1663; E04H 4/1636
See application file for complete search history.

(56) References Cited

U.S. PATENT DOCUMENTS

| | | | | |
|---|---|---|---|---|
| 4,742,593 | A | 5/1988 | Kallenbach | |
| 5,315,728 | A * | 5/1994 | Atkins | E04H 4/1663 137/798 |
| 5,863,425 | A * | 1/1999 | Herlehy | A47L 9/1427 15/1.7 |
| 2011/0088180 | A1* | 4/2011 | Kellogg | E04H 4/1663 15/1.7 |
| 2017/0159311 | A1* | 6/2017 | Stoltz | E04H 4/1654 |

OTHER PUBLICATIONS

PCT International Searching Authority; International Search Report and Written Opinion dated Nov. 1, 2018; entire document.

* cited by examiner

*Primary Examiner* — Shay Karls
(74) *Attorney, Agent, or Firm* — Merchant & Gould P.C.; Daniel R. Evans

(57) ABSTRACT

A pool cleaner comprises a body, a diaphragm cassette unit arranged inside the body, and a retention mechanism mounted on the body. The body extends between a water connection end and foot end, a foot end opening being defined at the foot end. The diaphragm cassette unit is arranged inside the body and includes a cassette extending to the foot end and a flexible diaphragm inside the cassette also extending to the foot end. The retention mechanism is mounted on the body and is operable to allow removal and reinstallation of the diaphragm cassette unit through the foot end opening.

17 Claims, 5 Drawing Sheets

POOL CLEANER WITH DIAPHRAGM CASSETTE UNIT AND RETENTION MECHANISM

CROSS-REFERENCE TO RELATED APPLICATION

This applications claims the benefit of U.S. Provisional Patent Application Ser. No. 62/545,716, filed on Aug. 15, 2017, the contents of which are herein incorporated by reference in their entirety.

FIELD OF THE INVENTION

The present invention relates to pool cleaners, and more particularly to suction-driven pool cleaners having a replaceable diaphragm.

BACKGROUND OF THE INVENTION

Generally, automatic pool cleaners are driven electrically or via water pressure. Water-driven cleaners fall into two categories: suction-driven and pressure-driven. A well-known type of suction-driven cleaner uses an internal diaphragm in the suction path to periodically interrupt water flow, causing the cleaner to creep along pool surfaces. These diaphragms must be flexible by design, and consequently are subject to wear and damage necessitating repeated replacement over the life of the cleaner. Removing the diaphragm to replace it requires some disassembly of the pool cleaner, and is often done by customers rather than service professionals. It is consequently desirable to make the removal and reinstallation process as easy as possible, without unduly complicating the overall design of the cleaner.

SUMMARY OF THE INVENTION

In view of the foregoing, it is an object of the present invention to provide an improved pool cleaner with a diaphragm cassette unit and retention mechanism. According to an embodiment of the present invention, a pool cleaner comprises a body, a diaphragm cassette unit arranged inside the body, and a retention mechanism mounted on the body. The body extends between a water connection end and foot end, a foot end opening being defined at the foot end. The diaphragm cassette unit is arranged inside the body and includes a cassette extending to the foot end and a flexible diaphragm inside the cassette also extending to the foot end. The retention mechanism is mounted on the body and is operable to allow removal and reinstallation of the diaphragm cassette unit through the foot end opening.

According to an aspect of the present invention, an outer pipe extends from an upper outer pipe end proximate the water connection end to a lower outer pipe end engaging the cassette. An inner pipe is arranged within the outer pipe and extends from an upper inner pipe end proximate the water connection end to a lower inner pipe end engaging the flexible diaphragm inside the cassette. The inner pipe is part of the diaphragm cassette unit and removable and reinstallable therewith upon operation of the retention mechanism.

According to another aspect of the present invention, the retention mechanism includes a first latch assembly, the first latch assembly having a first operator extending through a first latch opening defined in the body and a first latch movable by the first operator, the first latch releasably engaging a retention surface on the cassette.

According to a further aspect of the present invention, the first operator and the first latch are connected to opposite sides of a lever arm pivotable about a first pivot axis therebetween such that inward movement of the operator results in outward movement of the latch and disengagement of the retention surface.

According to an additional aspect of the present invention, the retention mechanism further includes a second latch assembly having a second operator extending through a second latch opening defined in the body and a second latch movable by the second operator, the second latch releasably engaging the retention surface. The second operator is pivotably connected to the outer pipe about a second pivot axis and pivotably connected to the second latch about a parallel pivot axis such that outward pivoting of the second operator results is disengagement of the second latch from the retention surface. The retention mechanism can further include a third latch assembly identical to the second latch assembly, a third operator extending through a third latch opening defined in the body on an opposite side from the second latch opening.

These and other objects, aspects and advantages of the present invention will be better appreciated in view of the drawings, and following detailed description of preferred embodiments.

DETAILED DESCRIPTION OF PREFERRED EMBODIMENTS

Figure 1:
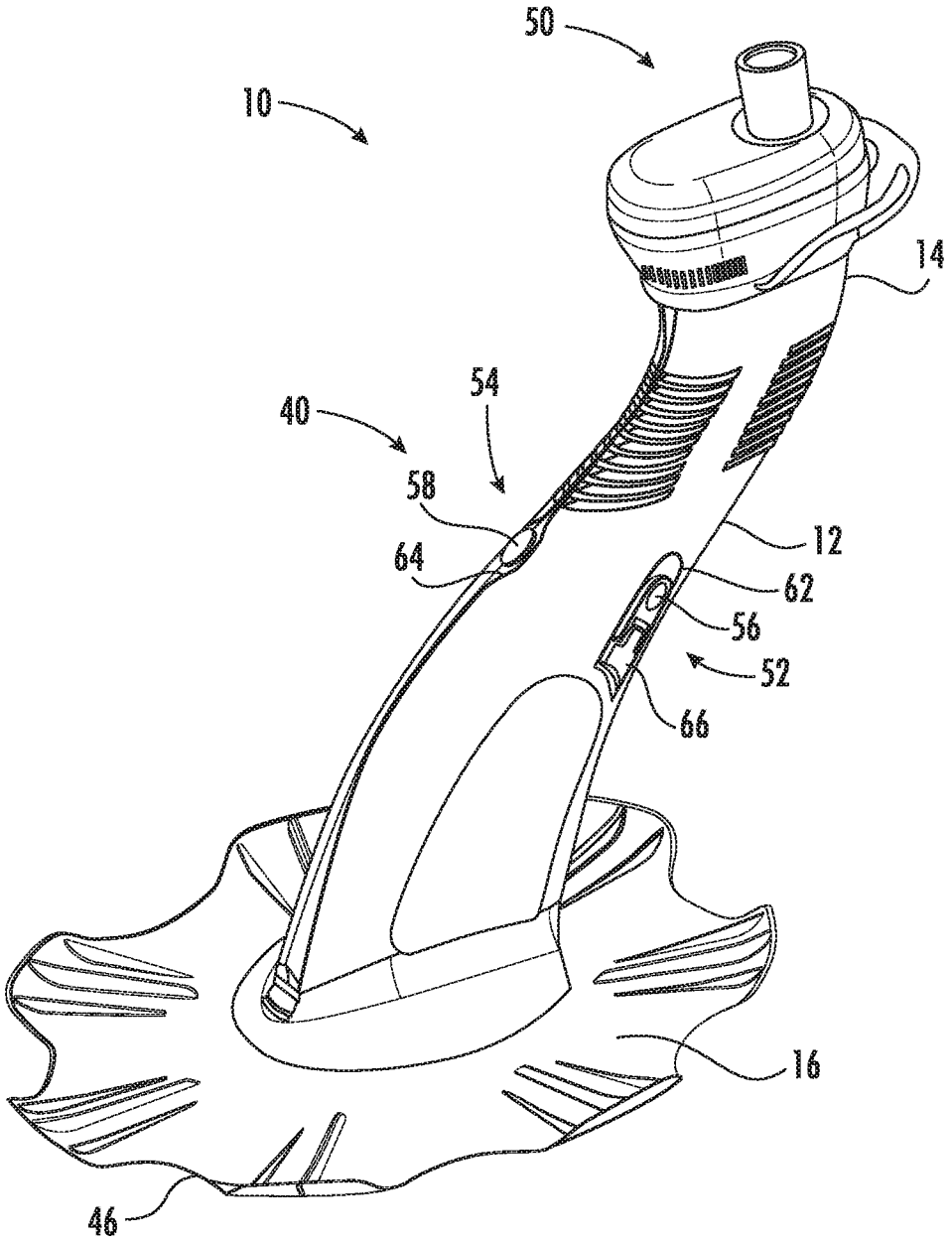
FIG. 1 is a perspective view of a pool cleaner with a diaphragm cassette unit and retention mechanism, according to an embodiment of the present invention.
Figure 2:
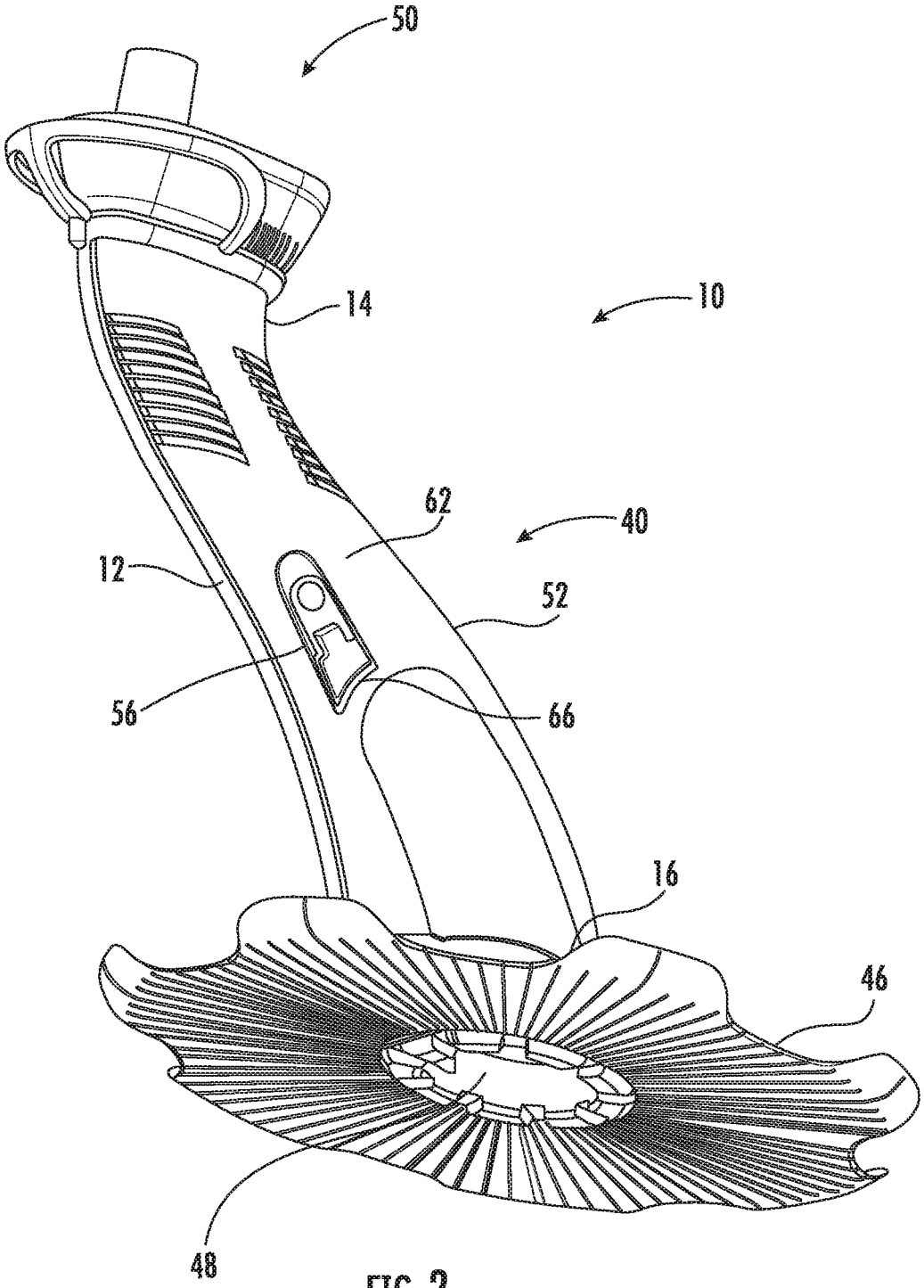
FIG. 2 is another perspective view of the pool cleaner of FIG. 1.
Figure 3:
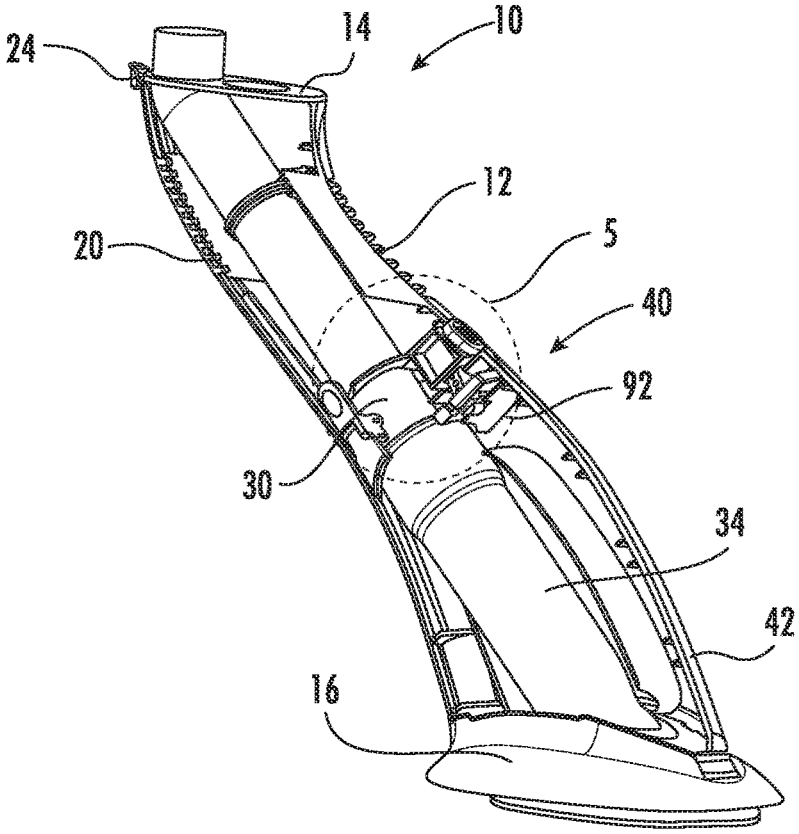
FIG. 3 is a side view of the pool cleaner of FIG. 1, partially cutaway to show an outer pipe and a cassette of the diaphragm cassette unit.
Figure 4:
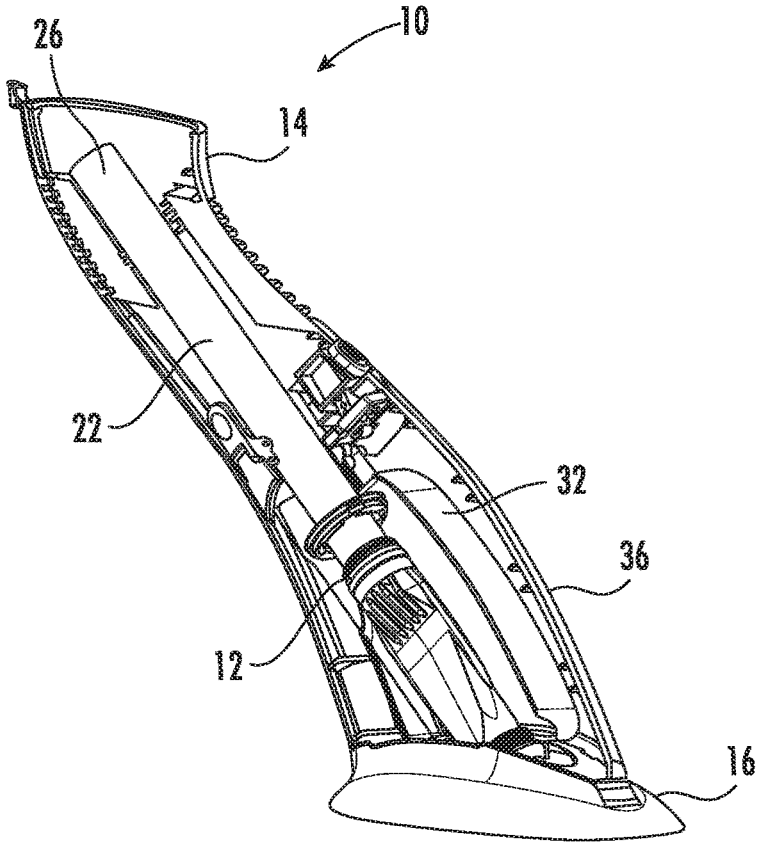
FIG. 4 is a side view of the pool cleaner of FIG. 1, partially cutaway as in FIG. 3, with the outer pipe and cassette removed to show an inner pipe and diaphragm.

Referring to FIGS. 1-4, a pool cleaner 10 includes a body 12 extending between a water connection end 14 and a foot end 16. The body 12 holds outer and inner pipes 20, 22 extending between respective upper ends 24, 26 proximate the water connection end 14 and lower ends 30, 32 toward the foot end 16 from the water connection end 14. A cassette 34 engages the lower end 30 of the outer pipe and extends to the foot end 16. Inside the cassette 34, a flexible diaphragm 36 engages the lower end 32 of the inner pipe 22 and also extends to the foot end 16. A retention mechanism 40 (shown in greater detail in FIG. 5) mounted on the body 12 is operable to allow removal and reinstallation of the cassette 34, inner pipe 22 and diaphragm 36 as a unit (referred to herein as the diaphragm cassette unit 42) through an opening 44 the foot end 16 (see FIG. 6).

In the depicted pool cleaner 10, a disc 46 is releasably secured to the foot end 16 by a foot pad 48. Before removing and reinstalling the cassette unit 42, the foot pad 48 and disc 46 are removed from the foot end 16. Before resuming operation, the foot pad 48 and disc 46 are reinstalled.

The depicted pool cleaner 10 also includes a steering mechanism 50 located at the water connection end 14. An exemplary steering mechanism can be seen in U.S. patent application Ser. No. 15/367,853, filed on Dec. 2, 2016, the contents of which are herein incorporated by reference in their entirety. Advantageously, removal and reinstallation of the diaphragm cassette unit 42 requires no access via the water connection end 14 nor removal of the steering mechanism 50.

Figure 5:
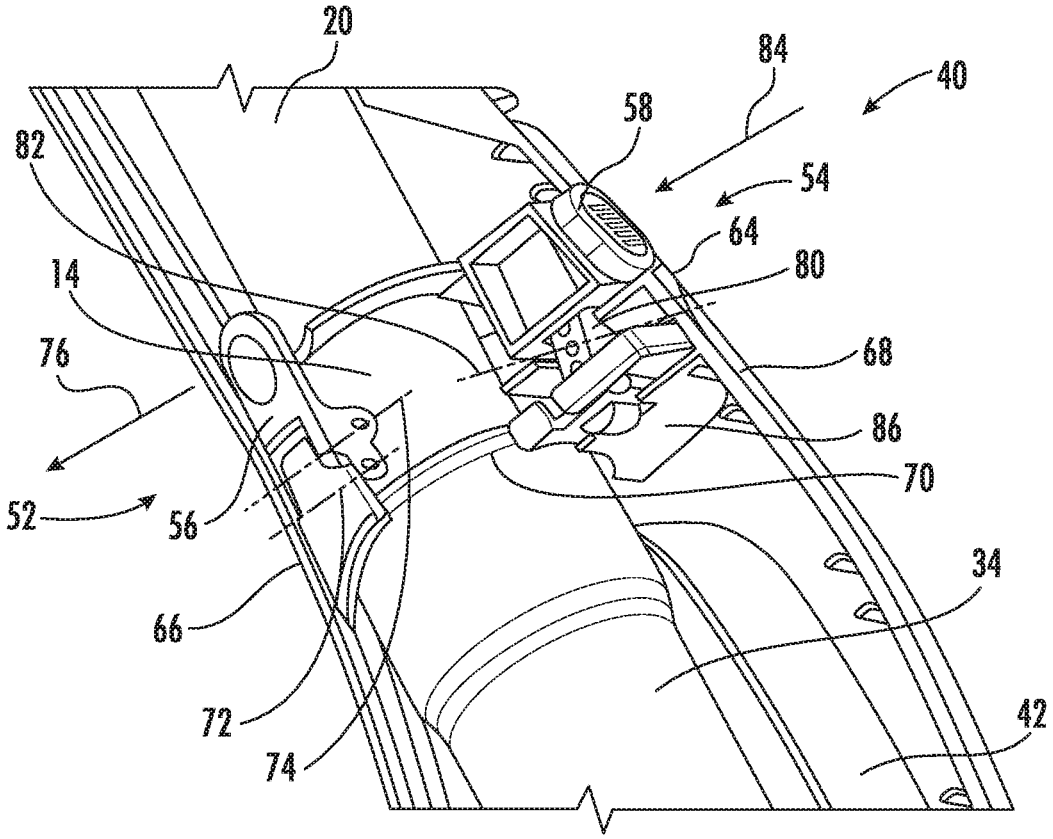
FIG. 5 is a detail view of area 5 of FIG. 3.

Referring particularly to FIG. 5, the retention mechanism 40 includes latch assemblies 52, 54 having operators 56, 58 extending through openings 62, 64 in the body 12 and latches 66, 68 movable by the operators 56, 58 to releasably engage a retention surface 70 on the cassette 34. In the depicted embodiment, the latch assemblies 52 are located on opposite sides of the body 12, while the latch assembly 54 is located on a trailing edge of the body 12. It will be appreciated that the number and configuration of latch assemblies could be varied. In practice, it has been found that the latch assembly 54 offers secure retention when used alone.

In each latch assembly 52, the operator 56 is pivotably connected to the outer pipe 20 about a pivot axis 72, and also pivotably connected to the latch 66 about a parallel pivot axis 74. By pivoting the operator 56 outwardly (in the direction of arrow 76), the latch 64 is disengaged from the retention surface 70. By pivoting the operator 56 inwardly (opposite arrow 76), the latch 66 is locked into engagement with the retention surface 70.

In the latch assembly 54, the operator 58 is connected to the latch 68 by a lever arm 80, which pivots about axis 82 such that inward movement of the operator 58 (in the direction of arrow 84) results in outward movement of the latch 68 and disengagement of the retention surface 70 thereby. Preferably, the operator 58 is biased outwardly (opposite arrow 84—e.g., by a spring) such that the latch 68 is urged into engagement with the retention surface 70. When reinstalling the diaphragm cassette unit 42, an angled lip 86 of the latch 68 engages the retention surface 70 such that the latch 68 moves outwardly until the retention surface 70 clears the lip. Once clear, the outwardly biasing of the operator 58 will automatically reengage the latch 68 under the retention surface 70.

Figure 6:
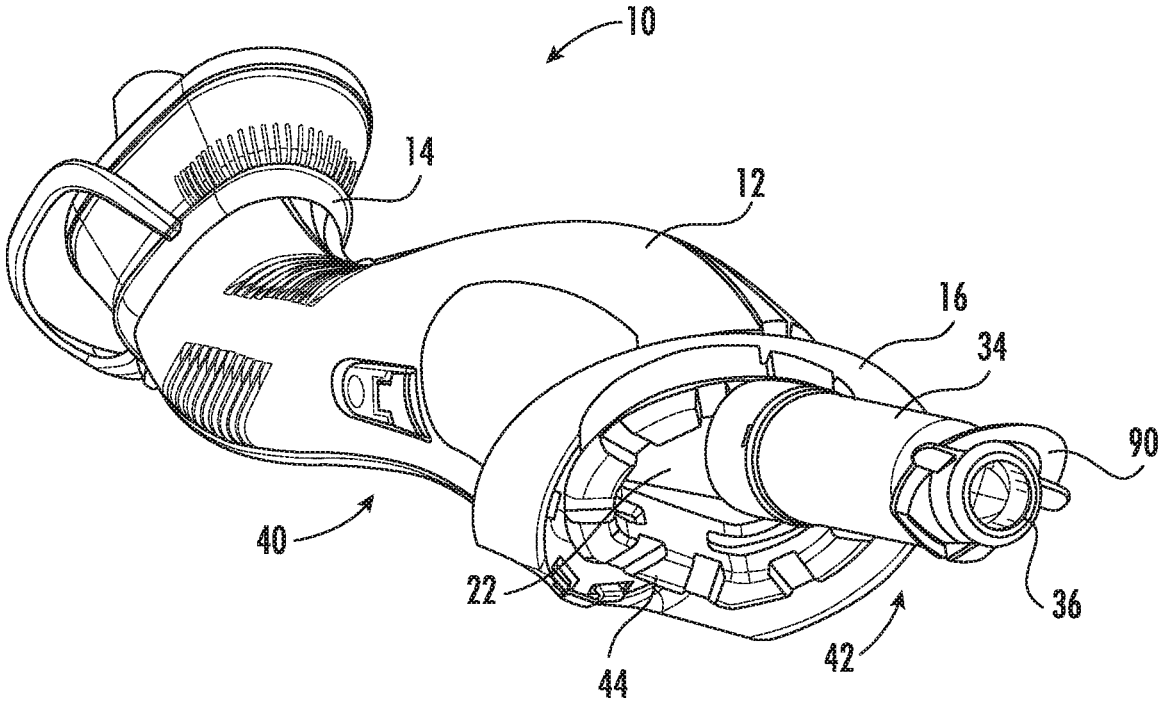
FIG. 6 is a perspective view of the pool cleaner of FIG. 1, showing the diaphragm cassette unit partially removed therefrom.

Referring also to FIG. 6, the lower end 90 of the cassette 34 is configured to ensure proper alignment and seating when inserted into the opening 44. Consequently, the retention surface 70 will be properly positioned for engagement by the retention mechanism 40 when the lower end 90 is properly seated against the opening 44. Additionally, the depicted retention surface 70 is formed by a single collar arranged around the upper end 92 of the cassette 34. It will be appreciated that the retention surface 70 is not necessarily a unitary structure, and could be otherwise configured.

In use, the pool cleaner 10 is typically removed from a pool and the foot pad 48 and disc 46 are removed. The latch assemblies 52 on either side of the body 12 are disengaged and the operator 58 is depressed to disengage the latch assembly 54, allowing the diaphragm cassette unit 42 to be removed via the opening 44. The cassette unit 42 is then disassembled to allow replacement of the diaphragm 36 and reassembled.

The reassembled diaphragm cassette unit 42 is reinserted through the opening 44 until the lower end 90 of the cassette 34 is properly seated and the retention surface 70 has cleared and been reengaged by the latch 68 of the latch assembly 54. The latch assemblies 52 are then reengaged, the disc 46 and foot pad 48 are reattached, and the pool cleaner 10 is again ready for use.

The foregoing is provided for illustrative and exemplary purposes; the present invention is not necessarily limited thereto. Rather, those skilled in the art will appreciate that various modifications, as well as adaptations to particular circumstances, are possible within the scope of the invention as herein shown and described and of the claims appended hereto.

What is claimed is:

1. A pool cleaner comprising:

a body extending between a water connection end and foot end, a foot end opening being defined at the foot end;

a diaphragm cassette unit arranged inside the body, the diaphragm cassette unit including a cassette extending to the foot end and a flexible diaphragm inside the cassette also extending to the foot end;

a retention mechanism mounted on the body, the retention mechanism being operable to allow removal and reinstallation of the diaphragm cassette unit through the foot end opening;

wherein the retention mechanism includes a first latch assembly, the first latch assembly having a first operator extending through a first latch opening defined in the body and a first latch movable by the first operator, the first latch releasably engaging a retention surface on the cassette; and wherein the first operator and the first latch are connected to opposite sides of a lever arm pivotable about a first pivot axis therebetween such that inward movement of the operator results in outward movement of the latch and disengagement of the retention surface.

2. The pool cleaner of claim 1, further comprising:

an outer pipe extending from an upper outer pipe end proximate the water connection end to a lower outer pipe end engaging the cassette; and an inner pipe arranged within the outer pipe and extending from an upper inner pipe end proximate the water connection end to a lower inner pipe end engaging the flexible diaphragm inside the cassette.

3. The pool cleaner of claim 2, wherein the inner pipe is part of the diaphragm cassette unit and removable and reinstallable therewith upon operation of the retention mechanism.

4. The pool cleaner of claim 1, further comprising a steering mechanism located at the water connection end;

wherein removal and reinstallation of the diaphragm cassette unit does not require removal of the steering unit.

5. The pool cleaner of claim 1, wherein the first operator is biased outwardly such that the first latch is urged into engagement with the retention surface.

6. The pool cleaner of claim 5, wherein the first latch includes an angled lip engaged by the retention surface when reinstalling the diaphragm cassette unit, the engagement therebetween moving the first latch outwardly until the retention surface is clear of the angled lip when the outward biasing of the first operator automatically reengages the first latch under the retention surface.

7. The pool cleaner of claim 1, wherein the first latch opening is located on a trailing edge of the body.

8. The pool cleaner of claim 1, wherein the retention mechanism further includes a second latch assembly having a second operator extending through a second latch opening defined in the body and a second latch movable by the second operator, the second latch releasably engaging the retention surface.

9. The pool cleaner of claim 8, further comprising:

an outer pipe extending from an upper outer pipe end proximate the water connection end to a lower outer pipe end engaging the cassette; and an inner pipe arranged within the outer pipe and extending from an upper inner pipe end proximate the water connection end to a lower inner pipe end engaging the flexible diaphragm inside the cassette;

wherein the second operator is pivotably connected to the outer pipe about a second pivot axis and pivotably connected to the second latch about a parallel pivot axis such that outward pivoting of the second operator results is disengagement of the second latch from the retention surface.

10. The pool cleaner of claim 9, wherein the retention mechanism further includes a third latch assembly identical to the second latch assembly, a third operator extending through a third latch opening defined in the body on an opposite side from the second latch opening.

11. The pool cleaner of claim 1, wherein a lower cassette end of the cassette is configured to ensure proper alignment and seating of the lower cassette end against the foot end opening with the diaphragm cassette unit inserted therein, the retention surface being properly positioned for engagement by the first latch with the lower cassette end properly aligned and seated against the foot end opening.

12. The pool cleaner of claim 1, wherein the retention surface is a single collar arranged around an upper cassette end of the cassette.

13. The pool cleaner of claim 1, further comprising:

a foot pad releasably secured to the foot end; and a disc releasably secured to the foot end by the foot pad.

14. A pool cleaner comprising:

a body extending between a water connection end and foot end, a foot end opening being defined at the foot end, and a first latch opening being defined on the body above the foot end;

an outer pipe extending from an upper outer pipe end proximate the water connection end to a lower outer pipe end;

a diaphragm cassette unit arranged inside the body, the diaphragm cassette unit including:

a cassette extending from an upper cassette end engaging the lower outer pipe end to a lower cassette end engaging the foot end opening;

an inner pipe extending from an upper inner pipe end inside the outer pipe proximate the water connection end to a lower inner pipe end inside the cassette; and a flexible diaphragm extending from an upper diaphragm end engaging the lower inner pipe end inside the cassette to a lower diaphragm end engaging the lower cassette end;

a retention mechanism mounted on the body, the retention mechanism being operable to allow removal and reinstallation of the diaphragm cassette unit through the foot end opening, the retention mechanism including:

a first latch assembly, the first latch assembly having a first operator extending through a first latch opening defined in the body and a first latch movable by the first operator, the first latch releasably engaging a retention surface on the cassette;

wherein the first operator and the first latch are connected to opposite sides of a lever arm pivotable about a first pivot axis therebetween such that inward movement of the operator results in outward movement of the latch and disengagement of the retention surface.

15. The pool cleaner of claim 14, wherein the first operator is biased outwardly such that the first latch is urged into engagement with the retention surface, and the first latch includes an angled lip engaged by the retention surface when reinstalling the diaphragm cassette unit, the engagement therebetween moving the first latch outwardly until the retention surface is clear of the angled lip when the outward biasing of the first operator automatically reengages the first latch under the retention surface.

16. The pool cleaner of claim 14, wherein the first latch opening is located on a trailing edge of the body and a pair of second latch openings are defined on opposite sides of the body, the retention mechanism further including a pair of second latch assemblies, each second latch assembly having:

a second operator extending through a respective one of the second latch openings; and a second latch movable by the second operator, the second latch releasably engaging the retention surface.

17. The pool cleaner of claim 16, wherein, in each of the second latch assemblies, the second operator is pivotably connected to the outer pipe about a second pivot axis and pivotably connected to the second latch about a parallel pivot axis such that outward pivoting of the second operator results is disengagement of the second latch from the retention surface.

* * * * *